United States Patent [19]

Musschoot

[11] Patent Number: 4,503,783

[45] Date of Patent: Mar. 12, 1985

[54] FURNACE ASH AIR SEAL

[75] Inventor: Albert Musschoot, Barrington, Ill.

[73] Assignee: General Kinematics Corporation, Barrington, Ill.

[21] Appl. No.: 512,173

[22] Filed: Jul. 11, 1983

[51] Int. Cl.[3] ..... F23G 5/00

[52] U.S. Cl. ..... 110/165 R; 432/77; 432/78

[58] Field of Search ..... 110/165 R, 165 A, 255, 110/259; 432/77, 78, 85

[56] References Cited

U.S. PATENT DOCUMENTS

| | | | |
|---|---|---|---|
| 2,118,651 | 5/1938 | Macchi | 110/165 R |
| 3,731,398 | 5/1973 | Niems | 432/78 |
| 3,920,380 | 11/1975 | Heian | 432/78 |
| 3,922,797 | 12/1975 | Dick | 432/85 |
| 4,076,493 | 2/1978 | Gardner | 432/77 |
| 4,123,850 | 11/1978 | Niems | 432/78 |
| 4,147,503 | 4/1979 | Herchenbach et al. | 432/78 |
| 4,171,948 | 10/1979 | Kraus et al. | 432/85 |
| 4,210,087 | 7/1980 | Melan et al. | 110/165 R |

*Primary Examiner*—Henry C. Yuen

*Attorney, Agent, or Firm*—Wood, Dalton, Phillips, Mason & Rowe

[57] ABSTRACT

According to the present invention, a sealing chamber is provided into which a noncombustible residue from an incinerator, furnace or the like is moved. The residue may be sprayed with a liquid upon entering the sealing chamber to effect cooling and compaction of the residue. The sealing chamber is provided with a vibratory discharge mechanism which serves to convey the residue out of the chamber and to compact the residue accumulated in a vertical column in the chamber to provide an effective seal against the diffusion and entry of air into the combustion area of the incinerator. Controls are provided in the sealing chamber to maintain the seal and to actuate the vibratory mechanisms for moving the residue. By the time the residue reaches the discharge of the chamber, the liquid in the residue is evaporated by the residual heat in the residue particles. The dried particles are thereafter transported by a transport conveyor from the outlet of the vibratory discharge conveyor to an appropriate point of disposal.

10 Claims, 2 Drawing Figures

FURNACE ASH AIR SEAL

DESCRIPTION

1. Field of the Invention

This invention relates to furnaces and more particularly to a seal for maintaining negative pressure in the ash discharge end of a combustion chamber of the furnace.

2. Background Art

Efficient combustion of solid fuels is achieved in controlled air incinerators, furnaces or the like by maintaining prescribed temperatures and pressures within a combustion chamber. This is generally accomplished by sealing the chamber from the ambient atmosphere. One problem that is particularly prevalent in the field is the disposition of incineration ash and other developed noncombustible residue without unbalancing the controlled burning conditions, as by inadvertently varying the pressure and/or temperature in the combustion chamber. Further, it is desirable that the temperature of the unburned residue be lowered substantially before disposal to be compatible with the stress capacity of the mechanism. Because residue cooling must proceed without appreciably varying the chamber temperature, additional complications arise.

Heretofore residue disposal from furnaces has been accomplished in numerous different manners. One exemplary arrangement is that disclosed in U.S. Pat. No. 2,558,626, to Pfau. In Pfau a tapered grate, fed from a hopper, has annular gaps through which residue escapes and is transferred to a conveyor and transported to a point of disposal.

In Pfau, the temperature of the grate, conveyor and associated mechanism are substantially elevated by coming into contact with the uncooled residue. Further, the loosely packed residue particles will readily admit air into the combustion chamber, thereby altering combustion characteristics.

The problem of pressure reduction is addressed in U.S. Pat. Nos. 3,023,716, 3,855,950, 4,321,877, consecutively to Reisman, Hughes Jr. et al and Schmidt et al. In Reisman separate ash collection hoppers are provided with an intermediate sliding seal door. By selectively positioning the door, the pressure in the uppermost chamber can be maintained as the residue is discharged from the lower chamber. The overall mechanism is complicated and thus costly, with no means disclosed for effectively cooling the unburned residue.

In Hughes Jr. et al, a ram is used to expel residue from the bottom of a discharge chamber. The ram compresses the ash and forces open a pivotally mounted gate that is maintained by gravitational forces in a lowered and closed position. The mechanism relies on the accumulated residue to prohibit entry of atmospheric air as well as the ram which progressively seals the discharge chamber opening as it extends. The overall mechanism, which is very complicated, will not positively seal the combustion chamber until the ram is fully extended.

Schmidt et al utilizes a horizontally movable pull plate beneath a combustion chamber which, upon actuation, feeds the ash which it supports to an ash collection chamber from where it is directed through a screw conveyor to a point of disposal. The plate is automatically controlled by an actuator so as to maintain the height of accumulated residue within a predetermined range. As in Hughes Jr. et al, Schmidt et al relies on the loosely maintained residue to seal the combustion chamber and prevent the entry of atmospheric air.

To overcome the above problems, a dual chamber arrangement is disclosed in U.S. Pat. No. 3,958,518, to Yoshida, including a lower ash collecting chamber which has an opening sealed by water in which it is immersed. A conveyor is provided to recover ash from the water tank.

The lighter residue particles however may not submerge. As a result of incomplete mixing, the ash will remain hotter than is desirable. Further, removal of the water and ash mixture is complicated and messy and requires either drying and settling tanks to dry the ash slurry before transporting for disposal or requires extra transport equipment to carry the wet ash and water for disposal.

The present invention is directed to overcoming one or more of the problems enumerated above.

SUMMARY OF THE INVENTION

According to the present invention, a sealing chamber is provided into which a noncombustible residue from an incinerator, furnace or the like is moved. The residue may be sprayed with a liquid upon entering the sealing chamber which liquid both cools the residue particles and enhances compaction of the residue particles. At least a portion of the sealing chamber is provided with a vibratory conveying mechanism which serves to move the residue upon demand and at the same time to more closely compact the residue accumulated in the chamber to provide an effective seal against the diffusion of outside air into the combustion area of the incinerator.

The present invention has as its principle object to provide a simple structure to create a barrier against introduction of uncontrolled atmospheric air into the combustion chamber. At the same time the heated residue is cooled so as not to unduly thermally stress any part of the discharge mechanism. The cooling liquid serves a dual function by both reducing the temperature of the residue and enhancing compaction of the residue to create a more effective barrier. It can be seen that by treating the residue to create a positive seal the need for more complicated sealing structure as in the prior art is obviated.

The sealing chamber has a discharge region located at the bottom of the chamber such that by the time the wetted residue has reached the discharge region, the liquid in the residue has substantially evaporated. The dried residue is much easier to transport than for example a water-saturated mixture as in the prior art. A conventional vibratory discharge conveyor directs the residue from the discharge area to a conventional vibratory transport conveyor which in turn move the residue to a desired point of disposal.

To assure that the height of the residue in the sealing chamber is sufficient to create an effective air barrier, level detectors are positioned at vertically spaced regions in the chamber. The vibratory conveyors respond to a signal from the detectors when the residue level is outside the range between the detectors. When the residue in the chamber reaches the height of the upper detector, the discharge and transport conveyors are actuated until the residue level reaches the lower detector at which point the discharge conveyor and the transport conveyor are shut down either simultaneously or in sequence.

DESCRIPTION OF THE PREFERRED EMBODIMENT

Figure 1:
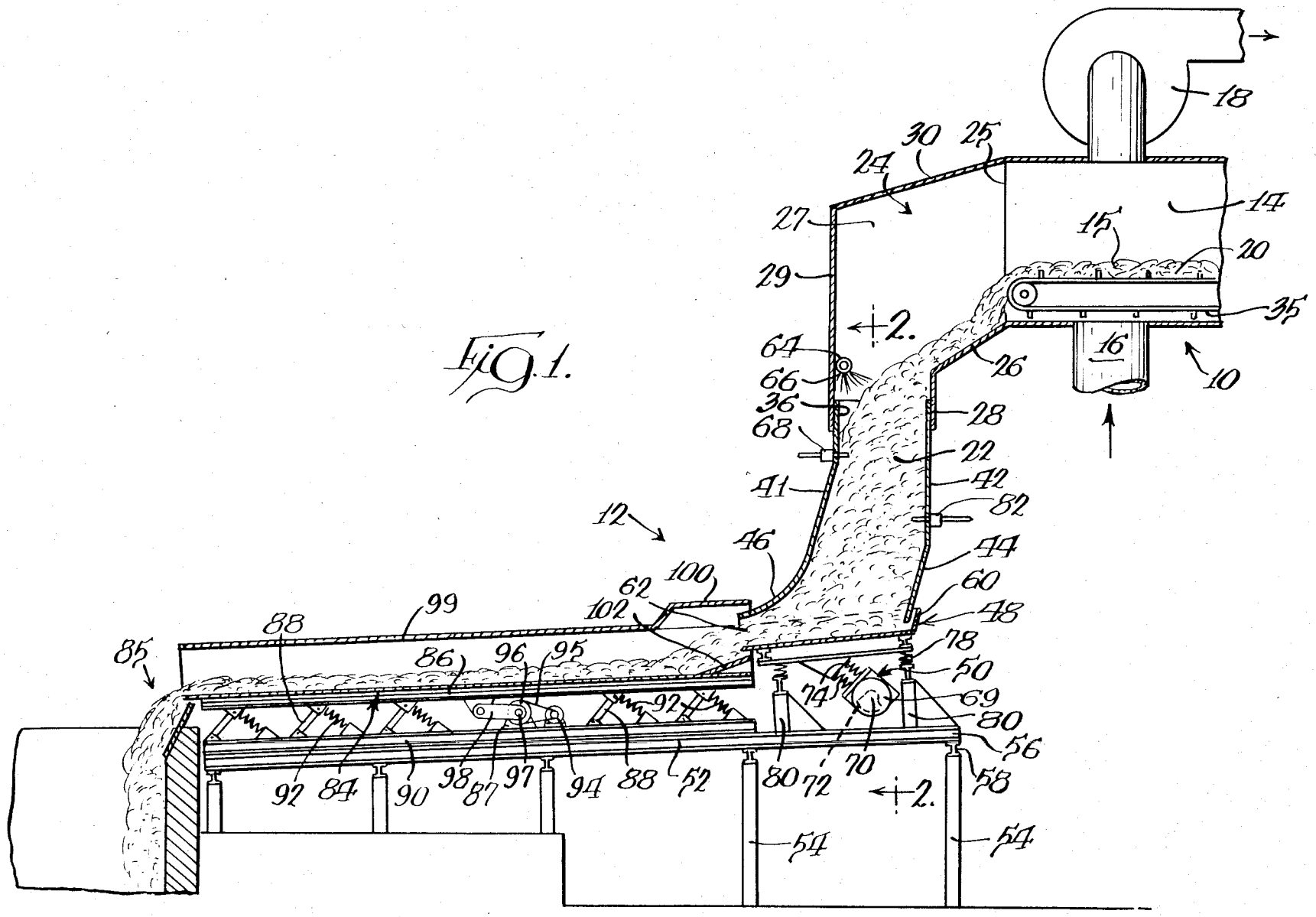
FIG. 1 is a side sectional elevation view of an furnace incorporating a preferred sealing structure according to the present invention.
Figure 2:
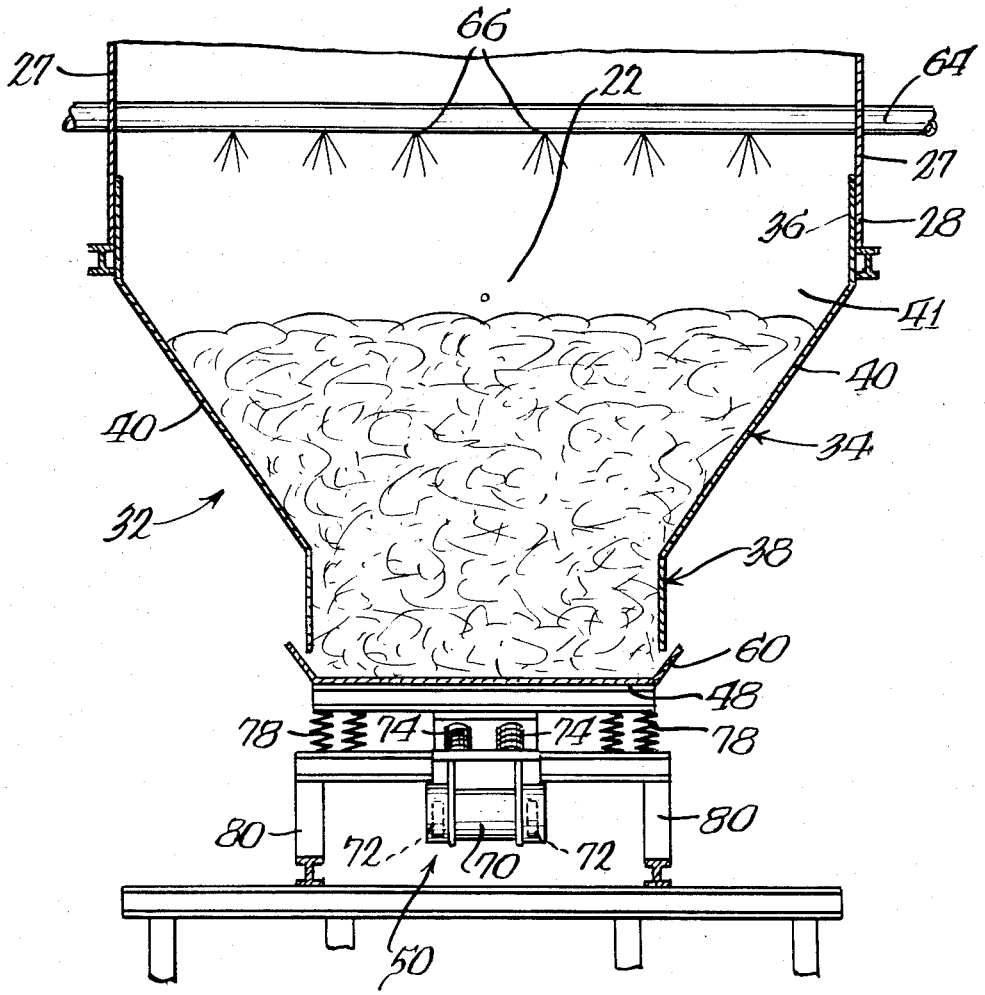
FIG. 2 is a sectional view of the sealing chamber taken along line 2—2 of FIG. 1.

A furnace or incinerator 10 incorporating a preferred sealing structure 12 is illustrated in FIGS. 1 and 2. The furnace 10 with which the invention is operable is conventional and includes a combustion chamber 14, combustion air intake 16 and suction blower 18. Solid fuel is burned under controlled temperature and pressure conditions. The forced draft from the intake 16 passes through the solid fuel 15 on grates 17 in the combustion chamber 14 to enhance the combustion of the fuel. As shown, a conventional movable grate 17 conveys the fuel through the combustion chamber and discharges the non-combustible ash or residue 20 into the sealing structure 12 of the furnace. Typically it is desirable to maintain a negative pressure of approximately four inches of water in the combustion chamber.

The sealing structure 12 comprises a vertically extending sealing chamber 22 having an upper enlarged hood 24 with an intake 25 in mating relationship with and in communication with the combustion chamber 14. The hood has a sloping deck 26 extending between vertical side walls 27 and connecting with a downwardly directed discharge tube 28. An end wall 29, opposite the intake 25, forms at its lower end a portion of the discharge tube 28 and at its upper end is connected to the sloping top wall 30 of the hood. Sloping grate bars 31 may extend between the side walls 27 and are spaced from the sloping deck 26 to convey the hot ash or residue from the combustion chamber into the sealing section without unduly heating the deck 26 of the hood.

As best seen in FIG. 2, the main housing 32 of the sealing chamber 22 has a hopper-shaped section 34 to funnel the residue downwardly from the deck 26 and grate bars 31 of the hood 24 and cause compaction of the same. The hopper section 34 is joined at its upper end with a rectangular box shaped entry portion 36 which mates with the discharge tube 28 of the hood 24. The hopper section 34 has sloping or converging side walls 40 (FIG. 2) and by slightly diverging front and rear walls 41,42 (FIG. 1), respectively. The hopper section 34 is joined with a discharge chute 38 which has a slanted rear wall 44 and a forward wall 46 diverging therefrom to accomplish redirection of the flow of residue from the vertical path from the sealing chamber to a horizontal path. The front wall 41 is tapered gradually to blend with the contour of the forward wall 46 of the discharge chute 38.

The housing 32 is mated telescopingly with the hood 24 which in turn makes airtight engagement with the combustion chamber 14. A trough 48 of a vibratory discharge conveyor 50 forms the supporting wall for the sealing chamber 22. That is, a conventional vibratory conveyor 50, such as is shown in the issued U.S. Pat. No. 3,089,582, dated May 14, 1963 and entitled "Vibratory Device", is mounted on a platform 52, which platform is illustrated as sloping downwardly away from the furnace. Although the platform 52 is shown built up on columns 54 with beams 56 supported on cross bars 58, it is understood that the platform could be a sloping concrete slab or the like. The operation of the vibratory device 50 will be described in greater detail hereinafter. The trough 48 defines the lower boundary of the chamber 22 and has side walls 60 which surround all but the forward wall 46 of the discharge chute 38 and in conjunction therewith defines a restricted outlet opening 62. The hood 24, box shaped portion 36, the hopper section 34, discharge chute 38 and trough 48 cooperatively make up the sealing chamber 22.

As the incoming residue passes between the hood 24 and the hopper section 34, it is quenched with a liquid which is preferably water. The water is pressurized in a laterally extending conduit 64 mounted in the hood 24 along the front wall 29 thereof and is expelled through a plurality of jets 66 and expanded to cover the horizontal cross-sectional area of the sealing chamber 22. As can be seen from FIGS. 1 and 2, the tube 28 of the hood has a sufficiently large cross-section that the residue will not build up in the tube 28 to a level that will restrict the flow of water from the jets 66.

The residue with the water from the jets flows downwardly and fills the area from the trough 48 through the discharge chute 38, hopper section 34 and into the entry portion 36 to form a vertical column of residue having a height controlled by an upper level detector 68. The upper level detector 68 is located in the transition area between the portion 36 and the hopper section 34 but its precise location is not critical. The weight of the moistened residue in the column causes close compaction in the column. When the level of the residue reaches the detector 68, the detector 68 will actuate the vibratory apparatus 50 which will convey some of the residue out of the column and will at the same time cause some compaction of the residue in the column. A second level control detector 82 is mounted in the hopper section 34 near the lower end of the hopper. The second detector 82 will sense when the column of residue has been lowered to the detector 82 whereupon the detector 82 will deactivate the vibratory device 50. The location of the lower or second level detector 82 is somewhat critical in that it must be high enough above the trough 48 to assure a seal so that air cannot flow from the discharge outlet 62 through the residue in the sealing chamber 22 into the combustion chamber. With the vibratory device 50 shut down, the residue will build up in the sealing chamber 22 until the level reaches the first detector 68 which will again activate the vibratory device 50.

The vibratory device 50 as shown in U.S. Pat. No. 3,089,582 has a motor 69 with a shaft 70 carrying unbalanced weights 72 at its opposite ends. The motor 69 is connected by resilient members 74 to a mounting 76 carried by the trough 48. The trough 48 is supported in turn upon springs 78 carried by the spaced supports 80 fixed on the platform 52. Rotation of the shaft 70 imparted by the motor 69 vibrates the trough 48 conveying the residue toward the left in FIG. 1 and at the same time providing a limited amount of compaction to the residue in the column. Because the outlet 62 is restricted, the residue will be maintained in the chamber 22 not only when the vibratory device is not operating, but also when the vibratory device is operating. The closely packed and wetted residue in the chamber 22 effects a positive seal to prevent the diffusion of ambient air into the combustion chamber through the ash discharge as would unbalance the burning conditions.

Aligned with the outlet 62 of the sealing chamber 22 and vibratory conveyor 50 is a material conveying vibratory apparatus 84 which receives residue from outlet 62 and conveys it to a point of disposal 85. The cooling water is substantially evaporated by the residual heat in the residue particles by the time the particles arrive at the outlet 62 so that conveyance of the residue is facilitated. A suitable transfer conveyor mechanism is shown in my U.S. Pat. No. 3,677,395, issued July 18, 1972.

As seen in FIG. 1, a covered trough 86 is pivotally connected by a plurality of links 88 to a base 90. A plurality of springs 92 are spaced lengthwise of the conveyor 84 and extend between the base 90 and the trough 86. The springs 86 are parallel with each other and are arranged at substantially a right angle with the connecting links 84.

To impart vibratory motion to the trough 86, a motor 94 is mounted on the base 90 with a belt drive 95 connected to an unbalanced member 96 on shaft 97 with connecting rods 98 connected to the trough 86. Rotation of the unbalanced member 96 causes a conveying vibratory motion to the trough 86 that moves the residue toward the discharge end 86.

The residue or ash is confined to the trough 86 by a cover 99 connected over the trough 86. The cover 99 has an enlarged inlet 100 extending surroundingly over the outlet 62 of the chamber 22. A ramp 102 is provided at the mouth of the trough 86 to direct the flow of residue from the trough 48 of conveyor 50 to the trough 86 of conveyor 84.

In operation the transport conveyor 84 and delivery conveyor 50 are actuated by upper level detector 68 and are shut down by the spaced, lower detector 82 to control the height of the residue in the column 22. When the residue achieves the height of the upper detector 68, both conveyors 84 and 50 are actuated through a conventional actuator (not shown), carrying away the dried residue collected in the sealing chamber to lower the level of the residue in the chamber. When the residue level falls below the lower detector 82, the conveyors 50 and 84 are cut out, permitting buildup of residue in the chamber 22. The control actuated level detector 82 may be such that conveyor 50 is shut down first with conveyor 84 operating for a short additional time to clear the residue from the trough 86. The heights of the level detectors 68,82 are chosen so that an effective seal is maintained throughout the entire range of residue levels therebetween.

It should be apparent that a positive barrier against passage of atmospheric air through the sealing chamber 22 is created by the moistened residue or ash which is cooled and compacted by the combined effect of the weight of the residue in the chamber 22 and the vibration of the conveyor 50.

The above description was made for purposes of clarifying the invention at hand with no unnecessary limitations to be derived therefrom.

I claim:

1. In a combustion apparatus of the type having a combustion chamber for burning solid fuels from which unburned residue is developed, the improvement comprising:

a sealing chamber into which at least a portion of the residue is transferred and having an outlet adjacent the bottom of the sealing chamber;

first means for transferring residue between the combustion chamber and the sealing chamber to form a column of residue in the sealing chamber;

means aligned with the bottom of the sealing chamber for supporting at least part of the weight of the residue in the sealing chamber;

means for vibrating the last named means to compact the residue in the sealing chamber and at the same time to convey some of the residue from the sealing chamber, a first level detector located in the sealing chamber for detecting the maximum height of the residue in the sealing chamber and for activating the vibrating means;

a second level detector located in the sealing chamber for detecting a minimum height of the residue in the sealing chamber and for shutting off the vibrating means; and said column of residue provides resistance to the passage of air from the atmosphere through the sealing chamber so as to maintain a negative pressure in the combustion chamber.

2. The apparatus of claim 1 wherein said sealing chamber has a vertically extending section and said residue is accumulated in the vertical section so that the weight of the column of residue in the sealing chamber compacts the residue into a substantially air tight mass that additionally resitsts the passage of air through the sealing chamber and into the combustion chamber.

3. The apparatus of claim 2 wherein said combustion chamber is arranged higher than the vertical section of the sealing chamber with at least a portion of the vertical section being hopper-shaped so that the residue from the combustion chamber is funnelled into a constricted portion of the vertical section.

4. The apparatus of claim 1 wherein vibratory conveyor means are provided adjacent the vibrating means for transporting the residue from the vibrating means to a point of disposal.

5. The apparatus of claim 1 wherein said first means is a hood in sealing relationship with the outlet of the combustion chamber.

6. In a combustion apparatus of the type having a combustion chamber for burning solid fuels from which unburned residue is developed, the improvement comprising:

a generally vertically disposed sealing chamber into which at least a portion of the residue is transferred, an outlet at the lower portion of said sealing chamber:

means aligned with the outlet for supporting the column of residue and for conveying the residue accumulated in the sealing chamber to a point of disposal; and level detectors provided in the sealing chamber to sense the maximum and minimum level of the residue in the sealing chamber, one of said detectors sensing the maximum height of the column and activating the conveying means to lower the level of the residue within the chamber and the other detector sensing the minimum height of the column and deactivating the conveyor means so that the height of the residue in the chamber will increase;

said column of residue collecting in the sealing chamber to provide resistance to the passage of air under atmospheric pressure through the sealing chamber and into the combusfion chamber whereby the combustion chamber is maintained under a negative pressure.

7. The apparatus of claim 6 wherein means are provided for spraying liquid onto the residue in the sealing chamber to cool the residue and to compact the residue by the washing action of the spray.

8. The apparatus of claim 7 wherein said spraying means is a conduit having a plurality of discharge jets and means to force the liquid through the conduit and out the discharge jets onto the column of residue.

9. The apparatus of claim 6 wherein additional conveying means are provided at the discharge of the first named conveying means to convey the residue from the first named conveying means to a point of disposal.

10. The apparatus of claim 6 wherein the vibratory action of the first named conveying means also compacts the residue in the sealing chamber to render said column of residue more resistant to the passage of air under atmospheric pressure.

* * * * *

UNITED STATES PATENT AND TRADEMARK OFFICE

CERTIFICATE OF CORRECTION

PATENT NO. : 4,503,783

DATED : March 12, 1985

INVENTOR(S) : Musschoot

It is certified that error appears in the above-identified patent and that said Letters Patent is hereby corrected as shown below:

Column 6, line 47, change colon to semi-colon

Column 6, line 64, change combusfion to combustion

Signed and Sealed this

*Tenth* Day of *December 1985*

[SEAL]

*Attest:*

DONALD J. QUIGG

*Attesting Officer*

*Commissioner of Patents and Trademarks*